US005383010A

United States Patent [19]

Sakurai

[11] Patent Number: 5,383,010

[45] Date of Patent: Jan. 17, 1995

[54] COLOR IMAGE FORMING APPARATUS WITH TRANSFER SHEET SHIFTING COMPENSATION MEANS

[75] Inventor: Masaaki Sakurai, Yokohama, Japan

[73] Assignee: Canon Kabushiki Kaisha, Tokyo, Japan

[21] Appl. No.: 79,914

[22] Filed: Jun. 23, 1993

[30] Foreign Application Priority Data

Jun. 24, 1992 [JP] Japan ..... 4-166208

[51] Int. Cl.[6] ..... G03G 15/01

[52] U.S. Cl. ..... 355/271; 355/327; 346/157; 358/501

[58] Field of Search ..... 355/271, 272, 274, 275, 355/326, 327; 271/193; 226/94; 358/300, 501; 346/157; 430/44

[56] References Cited

U.S. PATENT DOCUMENTS 5,041,877 8/1991 Matsumoto ..... 355/271

5,121,170 6/1992 Bannai et al. ..... 355/326

FOREIGN PATENT DOCUMENTS 55-32079 3/1980 Japan .

*Primary Examiner*—Joan H. Pendegrass

*Attorney, Agent, or Firm*—Fitzpatrick, Cella, Harper & Scinto

[57] ABSTRACT

The present invention intends to reduce the deterioration of the image quality due to the color deviation in an image forming apparatus wherein color toner images formed on an image bearing member are successively transferred onto a transfer sheet superimposedly to form a color image. In the apparatus wherein the transfer sheet conveying means supports the transfer sheet only by an electrostatic attraction force, since the adhesion condition of the transfer sheet on the transfer sheet conveying means differs between the first color and the other colors, the color toner image firstly transferred to the transfer sheet is an yellow color toner image which is a most unnoticeable color.

8 Claims, 4 Drawing Sheets

COLOR IMAGE FORMING APPARATUS WITH TRANSFER SHEET SHIFTING COMPENSATION MEANS

BACKGROUND OF THE INVENTION

1. Field of the Invention

The present invention relates to a color image forming apparatus such as an electrophotographic apparatus or an electrostatic recording apparatus using an electrophotographic photosensitive member, and more particularly, it relates to a color image forming apparatus wherein color toner images formed on an image bearing member are electrostatically transferred onto a transfer sheet carried by a bearing film acting as a transfer sheet bearing member.

2. Related Background Art

In a color electrophotographic copying machine of certain types, a transfer drum is made by mounting a bearing film (for bearing a transfer sheet) made of high-resistance resin around a drum-shaped frame as a transfer sheet bearing member. The transfer sheet is supplied to the drum and wound around the drum. In some cases, an end of the transfer sheet is mechanically secured to the drum by a gripper. In another case, when the transfer sheet is wound around the drum, an electrostatic attraction force is applied between the bearing film and the transfer sheet, thereby securing the transfer sheet on the bearing film (for example, refer to the Japanese Patent Laid-open No. 55-32079). During the transfer, the drum is rotated by several revolutions, and plural color toner images are electrostatically transferred from an image bearing member to the same transfer sheet in a superimposed fashion. To this end, a corona charger device is arranged on an inner surface of the bearing film or a conductive roller is provided to urge against the transfer sheet held by the bearing film, so that the charge having the polarity opposite to the toner images is applied to the transfer sheet. Thereafter, in order to separate the transfer sheet from the bearing film, a corona discharger is used to weaken the electrostatic attraction force (Coulomb's force) between the transfer sheet and the bearing film, and a blade is inserted between the transfer sheet and the bearing film, thereby separating the transfer sheet from the bearing film.

Among the above-mentioned various copying machines, the machine of the type wherein the transfer sheet is electrostatically .adhered to the bearing film can treat a plurality of transfer sheet at a time, for example, when the transfer sheet has a small size, in comparison with the machine of gripper type, and is effective for the effective image formation, and, thus, provides an excellent image forming means.

However, when the transfer sheet is held by the above-mentioned electrostatic attraction method, the transfer sheet and the bearing film are easily distorted as the transfer sheet is adhered to the bearing film, due to the deviation of the parallelism of axes between conventional register rollers and adsorption roller, the deviation of the parallelism of axes between the register rollers and the transfer sheet bearing member, and the deviation of the parallelism of axes between the adsorption roller and the transfer sheet bearing member.

Thus, a first color toner image is transferred onto the transfer sheet while remaining the distortion due to the above factors. A second color toner image, a third color toner image and so on are transferred onto the same transfer sheet while correcting the distortion, because the transfer sheet is separated from the register rollers and the adsorption roller and is completely secured to the bearing film. As a result, the first color image is deviated from the second, third color image and the like on the transfer sheet, thus deteriorating the image quality.

SUMMARY OF THE INVENTION

An object of the present invention is to provide a color image forming apparatus which eliminates the drawback of the apparatus having a gripper for securing a transfer sheet to a transfer sheet bearing member and which has the good productivity and which can obtain an image with high quality.

To achieve the above object, in the present invention, a color image forming apparatus for forming a color image by successively transferring color toner images formed on an image bearing member onto a transfer sheet superimposedly is constituted by an image bearing member moving endlessly, a plurality of color toner image forming means for forming toner color images including a yellow color toner image, transfer sheet conveying means movable endlessly to support the transfer sheet to which the toner images are to be transferred, and transfer means for transferring the color toner images formed on the image bearing members onto the transfer sheet carried by the transfer sheet conveying means.

The transfer sheet conveying means supports the transfer sheet only by an electrostatic attraction force, and the transfer sheet passes through a transfer position of the image bearing member as the transfer sheet conveying means is moved. When plural color toner images are successively transferred onto the transfer sheet at the transfer position, a color toner image which is firstly transferred is the yellow color toner image.

DETAILED DESCRIPTION OF THE PREFERRED EMBODIMENTS

The present invention will now be fully explained with reference to the accompanying drawings.

First of all, a first embodiment of the present invention will be described.

Figure 1:
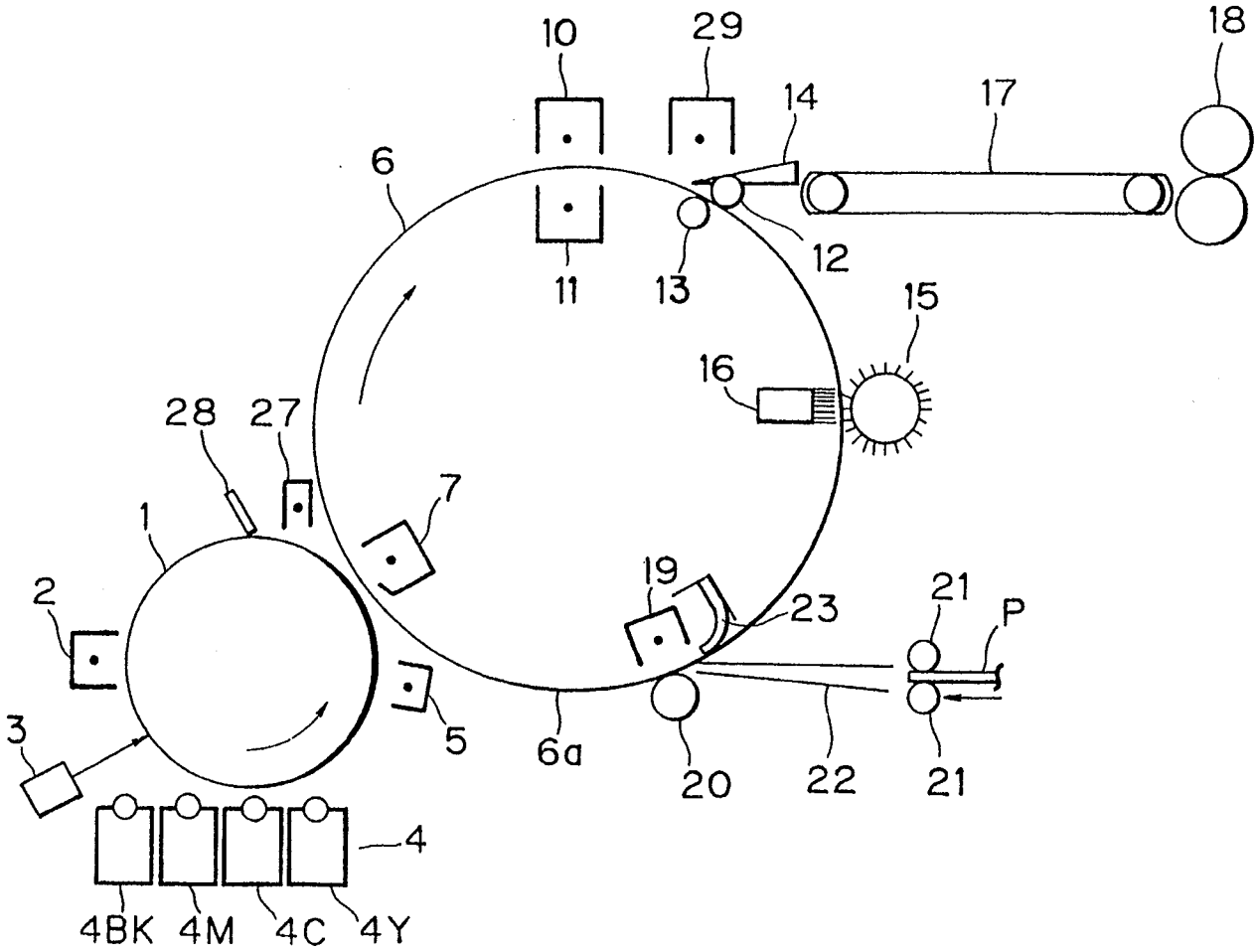
FIG. 1 is a schematic constructural view of a color image forming apparatus to which the present invention can be applied.

In FIG. 1, a photosensitive drum 1 as an image bearing member can be rotated in an anti-clockwise direction around its control axis. Around the peripheral surface of the photosensitive drum 1, there are arranged in order along its rotational direction a primary charger 2, an optical system 3, a developer supply device 4 and a secondary charger 5.

The primary charger 2 serves to uniformly charge the photosensitive drum 1, and the optical system 3 serves to apply a color-decomposed light image or equivalent light beam L to the surface of the photosensitive drum 1 at a predetermined timing, thereby forming an electrostatic latent image. For example, a laser beam exposure device is used as the optical system. Further, the developer supply device 4 can be shifted along a tangential direction while confronting to the surface of the photosensitive drum 1 and has four developing devices 4Y, 4C, 4M, 4BK each containing yellow color developer (toner), cyan color developer, magenta color developer and back color developer, respectively. The developer supply device 4 causes a developing device selected in response to the color light image or the equivalent light beam L from the optical system 3 to face the photosensitive drum 1, so that the latent image is developed with the color toner by flying the color toner, thereby forming the toner image.

Further, a transfer drum 6 is opposed to the photosensitive drum 1 while contacting with the photosensitive drum or with a small gap therebetween. The transfer drum 6 is constituted by cylindrically winding a bearing film 6a between cylindrical end frames. A corona charger 7 is disposed within the transfer drum in a confronting relation to the photosensitive drum 1. The transfer drum can be rotated in a clockwise direction. A adsorption corona charger 19 is disposed within the transfer drum 6 at an upstream side of the transfer position, and a conductive roller 20 is disposed in a confronting relation to the corona charger 19 with the interposition of the bearing film 6a. Further, at a downstream side of the transfer position, corona dischargers 10, 11 for removing the charge are disposed with the interposition of the bearing film 6a. Further, pushing rollers 12, 13 for separating a transfer sheet P (described later) from the bearing film 6a are disposed with the interposition of the bearing film 6a, and a separation blade 14 is arranged in the vicinity of the pushing rollers. At a further downstream side, a brush roller 15 for cleaning the holding surface of the bearing film 6a, and a corona discharger or a brush charge removing device 16 for removing the attraction force (remain of Coulomb's force or van der Waals force) are arranged.

Further, the transfer sheet P separated by the separation blade 14 is sent, via a conveyor 17, to a fixing rollers 18, where the toner images are fixed to the transfer sheet. Further, at an upstream side of the corona charger 19 and the conductive roller 20, there is arranged a transfer sheet supplying means for supplying the transfer sheet P to the holding surface of the bearing film 6a through a pair of regist rollers 21 and a guide 22.

In the illustrated embodiment, at a position where the transfer sheet P is supplied to the bearing film 6a, a distortion correcting means 23 comprising an elastic support member such as an elastic sheet having a thickness of 150 μm for example is disposed on a surface of the bearing film 6a opposed to the holding surface thereof. The distortion correcting means urges the bearing film 6a from the inside in order to correct or prevent the mechanical deformation 10 due to the brush roller 15 or the deformation due to the electrostatic force of the corona charger 19. The elastic force of the correction means 23 may act toward a direction for tensioning the bearing film 6a, i.e., a direction opposite to the shifting direction of the bearing film, with the result that it is possible to reduce the distortion of the bearing film 6a in a thrust direction (direction perpendicular to the tangential direction). Further, the circumferential discharge distribution of the corona charger 19 can also be regulated.

Incidentally, in FIG. 1, the reference numeral 27 denotes a charge removing device for removing the electrostatic charge from the surface of the photosensitive drum 1; and 28 denotes a cleaning blade for removing the toner. Further, in the vicinity of the separation blade 14, a corona charger 29 is arranged to effect the AC corona discharge, thereby preventing the distortion of the image due to the peeling discharge caused by the separation of the transfer sheet P from the bearing film 6a.

With this arrangement, after the surface of the photosensitive drum 1 is uniformly charged by the primary charger 2, when the color image passed through for example a blue filter from the optical system 3 is firstly illuminated onto the photosensitive drum, a latent image for yellow component is formed on the photosensitive drum. In synchronous with the movement of this latent image, the developer supply device 4 is shifted to the tangential direction with respect to the photosensitive drum 1, so that the developing device 4Y containing the yellow toner is opposed to the photosensitive drum 1, thereby forming the yellow toner image on the drum by electrostatically flying the yellow toner toward the drum.

On the other hand, the transfer sheet P is introduced into the guide 22 by the regist rollers 21 and then is supplied to the position of the conductive roller 20 along the surface of the bearing film 6a. Now, the transfer sheet P is electrostatically adhered to the bearing film 6a by the corona charger 19, so that the transfer sheet is sent to the transfer position between the photosensitive drum 1 and the transfer drum. In this case, the feeding timing of the regist rollers 21 is registered with the latent image forming timing of the optical system 3 so that the toner image is aligned with the transfer sheet. At the transfer position, the transfer corona charger 7 is driven to generate the transfer electric field, thereby transferring the toner image on the photosensitive drum 1 onto the transfer sheet P by the charge adhered to the bearing film.

The residual toner remaining on the photosensitive drum 1 is, after charge removal, removed by the blade 28, thereby cleaning the surface of the photosensitive drum 1. On the other hand, the transfer sheet P adhered to the bearing film 6a is shifted while carrying the toner image to pass through between the corona dischargers 10, 11 as the transfer drum 6 is rotated. In this case, however, the corona dischargers 10, 11 are not energized.

Further, the pushing rollers 12, 13 are also spaced apart from the bearing film 6a, and the brush roller 15 and the corona discharger or the brush charge removing device 16, and the conductive roller 20 are also spaced apart from the bearing film 6a, so that the transfer sheet is sent to the transfer position again through between the corona charger 19 and the conductive roller 20 without distorting the toner image on the transfer sheet P carried by the Coulomb's force. Incidentally, the energization of the corona charger 19 and the contact between the conductive roller 20 and the transfer sheet P are completed before a tip end of the toner image on the transfer sheet P reaches the position of the corona charger 19 and the conductive roller 20, so that the charge for attracting-the transfer sheet is not applied to the transfer sheet while the transfer sheet passes through between the elements 19, 20.

Further, the yellow toner image has already been formed before the tip end of the toner image reaches the transfer position, and, at the optical system 3, the color image passed through a red filter is illuminated onto the photosensitive drum 1. Since the developer supply device 4 shifts the developing device 4C to face it to the photosensitive drum 1, by electrostatically flying the cyan color toner toward the latent image, the cyan toner image is formed on the photosensitive drum 1. Thus, at the transfer position, the cyan color toner image is transferred onto the transfer sheet with superimposing with the previous yellow color toner image.

In this way, in the optical system, the blue filter, red filter and green filter are successively used so that plural color decomposed latent images for the same image are formed on the photosensitive drum 1, and, in response to the latent images, the yellow toner, cyan toner and magenta toner are successively supplied from the developer supply device 4 to the photosensitive drum 1, thereby performing color development as a whole.

After the last color (in the illustrated embodiment, magenta color) toner image has been transferred onto the transfer sheet P, when the transfer sheet is then passed through between the corona charger 19 and the conductive roller 20, these elements 19, 20 are energized to remove the charge, and the pushing rollers 12, 13 are urged against the bearing film 6*a* to increase the curvature of the bearing film, thereby aiding the separation of the transfer sheet P from the bearing film 6*a*.

Further, the separation blade 14 is contacted with or shifted in the vicinity of the bearing film 6*a*, thereby separating the leading end of the transfer sheet P from the bearing film 6*a*. The separated transfer sheet is sent to the fixing rollers 18 by the conveyor 17, and then the toner images are fixed to the transfer sheet. During the separating operation, it is preferable to prevent the distortion of the image due to the peeling discharge by means of the corona discharger 29. Further, after the transfer sheet P has been separated, the surface of the bearing film 6*a* is cleaned by the brush 15. In this case, if the residual toner still has the electrostatic attraction force, since the cleaning cannot be effected completely, the electrostatic attraction force is removed by the corona discharger or the brush charge removing device 16, thereby improving the cleaning efficiency. In this way, the color image can be copied.

Incidentally,.when the filters are not used in the optical system 3 and the developing device 4BK of the developer supply device 4 is opposed to the photosensitive drum 1, the normal mono-color copy can be obtained. In this case, since only one transferring operation is effected, various elements acts in the same manner as the last color toner image is transferred. Further, in the final step of the color development, the black images may be superimposed by using the white exposure and the black developer.

With this arrangement, since it is very difficult to maintain the axes of the regist rollers 21, the axis of the conductive roller 20 and the axis of the photosensitive drum 1 in parallel with each other, at the first color image forming operation, the transfer sheet will be distorted as mentioned above.

On the other hand, in the second color image forming operation, third color image forming operation and so on, since the conductive roller 20 does not influence upon the transfer sheet P at all, the distorted transfer sheet is gradually deformed to correct the distortion therein, with the result that the deviation occurs between the first color toner image and the superimposed second, third color toner images.

However, in the illustrated embodiment, by forming the first image with the yellow color which is most insensitive to the color tone, it is possible to always obtain the image with high quality. Further, while the transfer sheet was adhered to the bearing film by using the corona charger 19 and the conductive roller 20, these elements may be omitted, and, alternatively, the adhesion of the transfer sheet and the transferring of the image to the transfer sheet may be simultaneously effected by the electrostatic force of the transfer charger 7.

Next, a second embodiment of the present invention will be explained.

As another embodiment, a pulse width modulation method may be used to write an image.

Figure 2:
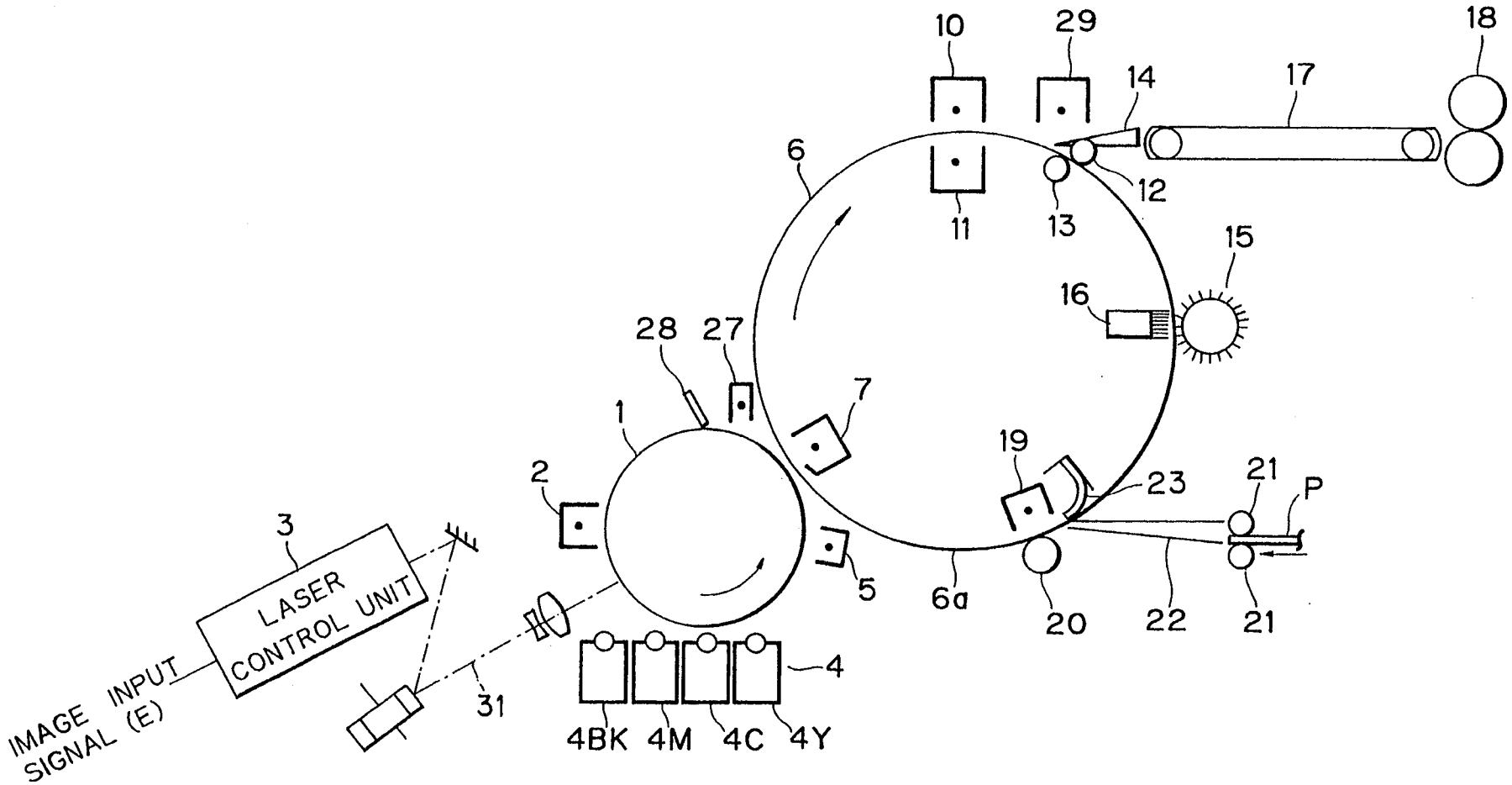
FIG. 2 is a schematic constructural view of a color image forming apparatus according to another embodiment of the present invention.
Figure 3:
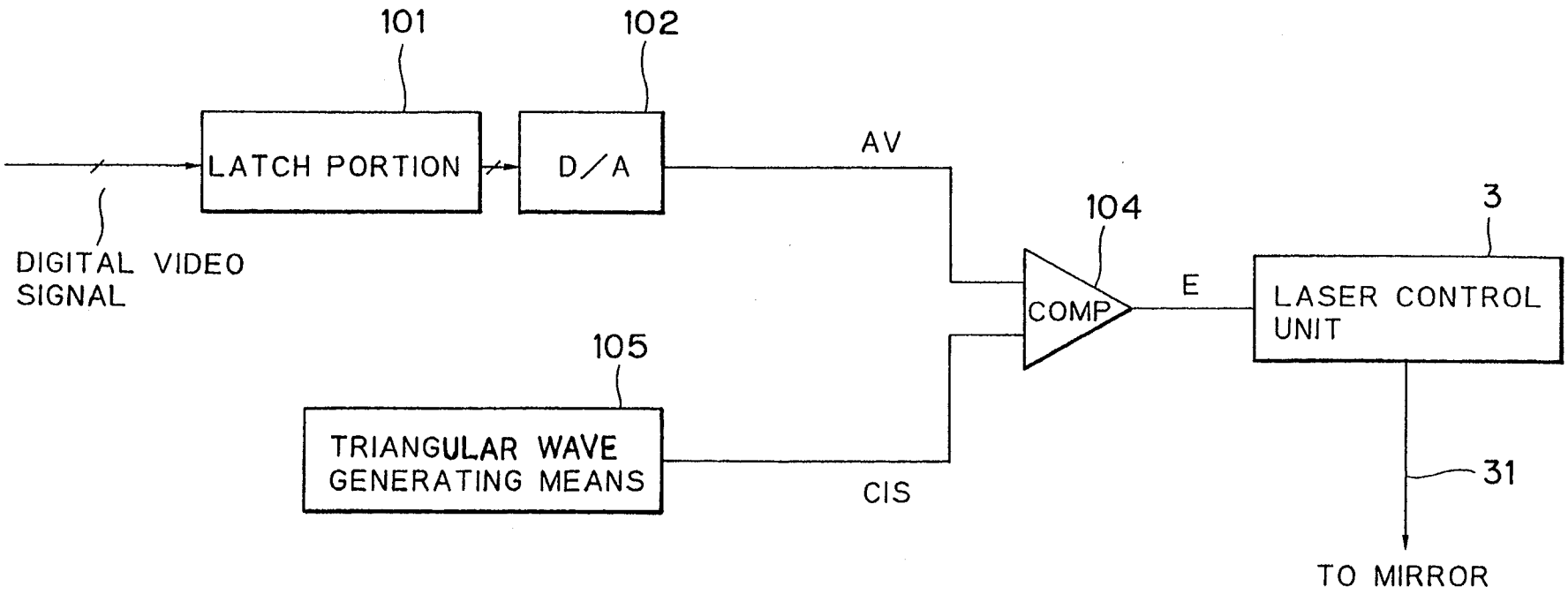
FIG. 3 is a circuit of a light information generating portion of the apparatus of FIG. 2.

In FIG. 2, an image signal sent from an external equipment (not shown) is inputted to a laser control unit 3. That is, as shown in FIG. 3, the inputted digital video signal is latch-converted at a latch portion 101, and then is converted into an analogue video signal AV at a D/A converter 102. The signal AV is inputted to one of terminals of a comparator 104. A triangular wave signal CIS generated by a triangular wave generating means 105 is inputted to the other terminal of the comparator 104. The comparator 104 compares the analogue video signal AV with the triangular wave signal CIS to generate a pulse width modulated signal E which is in turn sent to the laser unit 3. On the basis of this signal E, a semi-conductor laser is driven, thereby emitting a laser beam 31 flash-modulated in response to the modulated signal E. By changing the synchronism of the triangular wave which is a comparison wave, it is possible to change the number of lines during the image formation.

Incidentally, by decreasing (making rough) the number of yellow lines less than those of other color lines, it is possible to obtain the image with high quality even when the parallelism of the axes of the regist rollers and the transfer drum are worsened. For example, when the magenta, cyan and black developers are written with 200 lines, particularly by writing the yellow developer with 100–133 lines, the excellent result could be obtained. Further, when only the image regarding the yellow developer was further treated and the yellow dots were concentrated, the excellent result could also be obtained.

Lastly, a third embodiment of the present invention will be explained.

Figure 4:
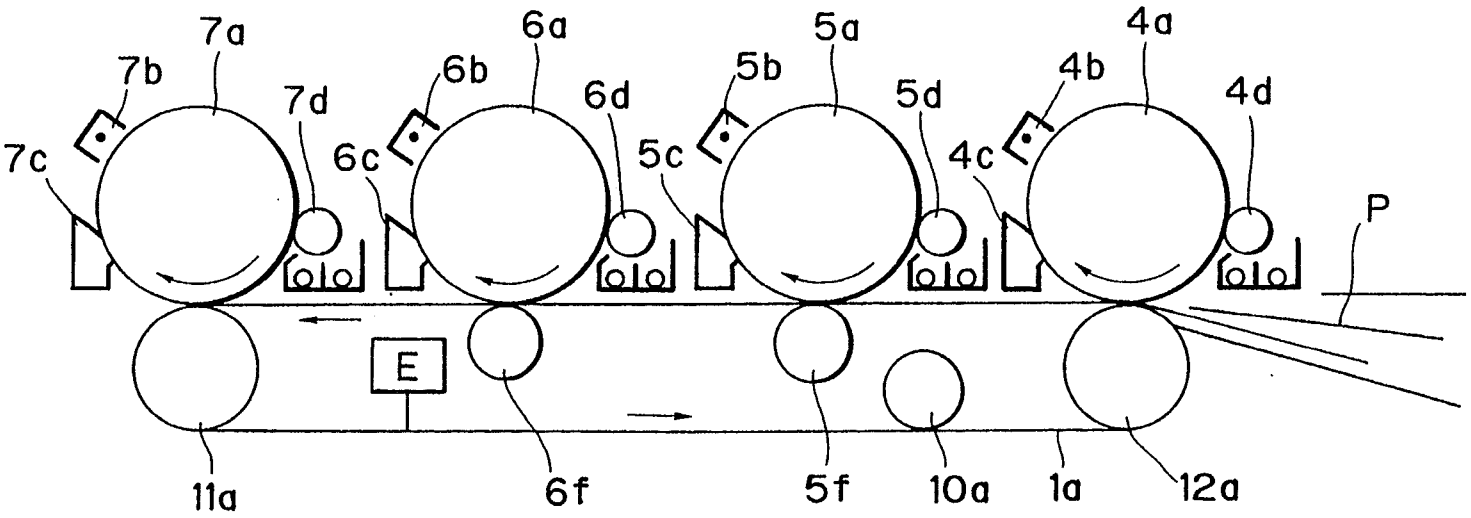
FIG. 4 is a schematic constructural view of a color image forming apparatus according to a further embodiment of the present invention.

FIG. 4 shows a main portion of a full-color printer wherein four photosensitive drums are used. In this full-color printer, latent images are formed on the photosensitive drums 4*a*, 5*a*, 6*a*, 7*a* by laser scanners (not shown) in response to image signals. Thereafter, the latent images are developed by developing devices 4*d*, 5*d*, 6*d*, 7*d* to form toner images on the photosensitive drums. Then, the toner images are successively transferred onto a transfer sheet supplied on a transfer belt 1*a* by using transfer rollers.

A fixing unit (not shown) is arranged at a downstream side of a belt drive roller 11*a*, which fixing unit thermally fuses the toner images to the transfer sheet by a pair of heat rollers, thereby obtaining the full-color image. This printer is designed so that a bias is applied to a driven roller 12*a* for supporting the belt 1*a* arranged an upstream side in the transfer sheet feeding direction and the first color photosensitive drum 4*a* is opposed to the driven roller 12*a*, whereby this roller 12*a* serves as a belt supporting roller, a transfer roller and an adsorption roller simultaneously.

The transfer rollers 5f, 6f, 11a are made of conductive resin, and the belt drive roller 11a is made of rubber having high surface friction of coefficient. Further, since the feeding force for the transfer sheet can be obtained by the belt unit, the transfer sheet is previously adhered to the transfer belt 1a electrostatically, and at the same time when the transfer sheet has just passed through the first color photosensitive drum 4a, the transfer sheet is electrostatically adhered to the belt by the current applied during the first color toner image transferring operation. By adopting the simultaneous transfer and attraction, any attraction high voltage output device can be omitted, thereby saving the consumption electric power and simplifying the power source means.

Further, since the position where the transfer sheet P is supplied to the belt 1a coincides with a nip between the drum 4a and the belt 1a, it is possible to improve the entry angle of the sheet with respect to the drum 4a, thereby permitting the supply of the transfer sheet at an appropriate angle. For example, when a transfer sheet such as a thick sheet having greater resiliency is curled upwardly, if the position where the transfer sheet is supplied to the belt 1a is situated at an upstream side of the position shown in FIG. 4, when the curled leading end of the transfer sheet is supplied in a floating condition, the leading end of the sheet will be struck against the photosensitive drum, thus distorting the image and/or damaging the drum. To the contrary, when the transfer sheet is supplied toward a great curvature portion defined between the drum and the transfer belt, such inconvenience can be avoided.

Also in this embodiment, regarding the most upstream photosensitive drum 4a, by using the developing device 4d containing the yellow toner, it is possible to obtain the image with high quality even when the degree of parallel between the regist rollers and the most upstream photosensitive drum 4a is worsened. Further, also in this embodiment, in a condition that the yellow color is set as the first color, by changing the number of lines illuminated on the photosensitive drum 4a as in the aforementioned second embodiment, it is possible to make the deviation between the first image and the second, third images unnoticeable.

Incidentally, in the above-mentioned embodiments, while the electrostatic attraction was generated by the corona charger and the conductive roller, the bias may be directly applied from a power source E (FIG. 4) to a conductive layer of the transfer sheet conveying means.

According to the present invention, in an image forming apparatus wherein a transfer sheet is supplied to a transfer sheet supporting means having no gripper and then toner images are successively transferred onto the transfer sheet in a superimposed fashion, since a first color image which easily causes the positional deviation is developed by yellow developer which is most insensitive to the color deviation, it is possible to make the transfer deviation unnoticeable as much as possible. Further, in an image forming apparatus using the illumination of light information of laser beam, since the first image is developed by the yellow developer and the number of pixcels of the yellow image is decreased to develop the image roughly, it is possible to make the transfer deviation between the first color image and the second, third color images unnoticeable.

What is claimed is:

1. An image forming apparatus wherein color toner images formed on an image bearing member are successively transferred onto a transfer sheet superimposedly to form a color image, comprising:

an image bearing member shiftable endlessly;

electrostatic latent image forming means for forming color toner images including a yellow color on said image bearing member, said electrostatic latent image forming means forming the electrostatic latent image on said image bearing member;

image forming means for forming color toner images by developing the electrostatic latent image with the plurality of color toners;

transfer sheet conveying means supporting a transfer sheet on which the toner images are to be transferred for shifting endlessly; and transfer means for transferring the color toner images formed on said image bearing member onto the transfer sheet supported by said transfer sheet conveying means, wherein said transfer sheet conveying means supports the transfer sheet only by an electrostatic attraction force, and the transfer sheet passes through a transfer position of said image bearing member as said transfer sheet conveying means is shifted, and wherein, when plural color toner images are successively transferred onto the transfer sheet, the color toner image firstly transferred at said transfer position is a yellow color toner image and wherein upon formation of the latent image of yellow color, scanning lines for the latent image of yellow color are coarser than for other color toners.

2. An image forming apparatus according to claim 1, wherein a single image bearing member is opposed to a single transfer sheet conveying means, and the transfer sheet is repeatedly sent to said transfer position of said image bearing member as said transfer sheet conveying means is shifted endlessly thereby successively transferring the color toner images onto the transfer sheet.

3. An image forming apparatus according to claim 1, wherein a plurality of image bearing members are opposed to a single transfer sheet conveying means, and the transfer sheet is sent to transfer positions of said image bearing members successively as said transfer sheet conveying means is shifted endlessly, thereby successively transferring the color toner images onto the transfer sheet.

4. An image forming apparatus wherein color toner images formed on an image bearing member are successively transferred onto a transfer sheet superimposedly to form a color image, comprising:

an image bearing member shiftable endlessly;

electrostatic latent image forming means for forming color toner images including a yellow color on said image bearing member, said electrostatic latent image forming means forming the electrostatic latent image on said image bearing member;

image forming means for forming color toner images by developing the electrostatic latent image with the plurality of color toners;

transfer sheet conveying means supporting a transfer sheet on which the toner images are to be transferred for shifting endlessly;

electrostatic force generating means for adhering the transfer sheet supplied to said transfer sheet conveying means to said transfer sheet conveying means by an electrostatic force; and transfer means for transferring the color toner images formed on said image bearing member onto the transfer sheet supported by said transfer sheet conveying means;

wherein said transfer sheet conveying means supports the transfer sheet only by an electrostatic attraction force, and the transfer sheet passes through a transfer position of said image bearing member as said transfer sheet conveying means is shifted, and wherein, when plural color toner images are successively transferred onto the transfer sheet, the color toner image firstly transferred at said transfer position is a yellow color toner image and wherein upon formation of the latent image of yellow color, scanning lines for the latent image of yellow color are coarser than for other color toners.

5. An image forming apparatus according to claim 4, wherein one image bearing member is opposed to one transfer sheet conveying means, and the transfer sheet is repeatedly sent to said transfer position of said image bearing member as said transfer sheet conveying means is shifted endlessly, thereby successively transferring the color toner images onto the transfer sheet.

6. An image forming apparatus according to claim 4, wherein a plurality of image bearing members are opposed to one transfer sheet conveying means, and the transfer sheet is sent to transfer positions of said image bearing members successively as said transfer sheet conveying means is shifted endlessly, thereby successively transferring the color toner images onto the transfer sheet.

7. An image forming apparatus according to claim 4, wherein said electrostatic force generating means has a charging device.

8. An image forming apparatus according to claim 4, wherein said electrostatic force generating means has a bias voltage to said transfer sheet conveying means.

* * * * *

UNITED STATES PATENT AND TRADEMARK OFFICE

CERTIFICATE OF CORRECTION

PATENT NO. : 5,383,010

DATED : January 17, 1995

INVENTOR(S) : MASAAKI SAKURAI

It is certified that error appears in the above-indentified patent and that said Letters Patent is hereby corrected as shown below:

Column [57] ABSTRACT,
line 12, "an" should read --a--.

Column 1,
line 48, ".adhered" should read --adhered--; and
line 49, "sheet" should read --sheets--.

Column 3,
line 9, "back" should read --black--;
line 23, "A" should read --An--;
line 42, "to a" should read --to--; and
line 48, "regist" should read --register--.

Column 4,
line 17, "synchronous" should read --synchronism--;
line 26, "regist" should read --register--;
line 33, "regist" should read --register--; and
line 64, "attracting-the" should read --attracting the--.

Column 5,
line 45, "Incidentally,." should read --Incidentally,--;
line 50, "acts" should read --act--;
line 56, "regist" should read --register--; and
line 64, "upon" should be deleted.

UNITED STATES PATENT AND TRADEMARK OFFICE

CERTIFICATE OF CORRECTION

PATENT NO. : 5,383,010

DATED : January 17, 1995

INVENTOR(S) : MASAAKI SAKURAI

It is certified that error appears in the above-indentified patent and that said Letters Patent is hereby corrected as shown below:

Column 6,
line 37, "regist" should read --register--; and
line 64, "an" should read --at an--.

Column 7,
line 37, "regist" should read --register--; and
line 64, "pixcels" should read --pixels--.

Signed and Sealed this

Second Day of May, 1995

Bruce Lehman

BRUCE LEHMAN

*Commissioner of Patents and Trademarks*

*Attest:*

*Attesting Officer*